US005608992A

United States Patent [19]

Floyd

[11] Patent Number: 5,608,992

[45] Date of Patent: Mar. 11, 1997

[54] FIRE RESISTANT HOUSE COVER

[76] Inventor: April Floyd, 18433 Bohnert Rd., Rialto, Calif. 92377

[21] Appl. No.: 493,354

[22] Filed: Jun. 21, 1995

[51] Int. Cl.[6] ..... E04B 1/34

[52] U.S. Cl. ..... 52/3; 52/23; 52/DIG. 12; 52/DIG. 14; 135/96; 135/115; 135/119

[58] Field of Search ..... 52/23, 3, 4, DIG. 14, 52/DIG. 11, DIG. 12, 63, 67, 169.1; 135/95, 96, 128, 134, 137, 150, 115, 119, 120.3, 120.4

[56] References Cited

U.S. PATENT DOCUMENTS

| | | | |
|---|---|---|---|
| 2,365,127 | 12/1944 | Wagner | 160/120 |
| 3,715,843 | 2/1973 | Ballinger | 52/3 |
| 4,858,395 | 8/1989 | McQuirk | 52/3 |
| 5,285,603 | 2/1994 | Richard et al. | 52/DIG. 12 X |
| 5,423,150 | 6/1995 | Hitchcock | 52/DIG. 12 X |

*Primary Examiner*—Carl D. Friedman
*Assistant Examiner*—Timothy B. Kang
*Attorney, Agent, or Firm*—David L. Volk; Brendan B. Dix

[57] ABSTRACT

The present invention relates to a fire isolation device for a free standing structure. This device includes a left tarp and right tarp fabricated from a fire resistant material. The left tarp and right tarp are of a size to completely enclose the free standing structure. Attached to the left tarp and right tarp is a support structure, which is capable of moving from an upward position where the left tarp and the right tarp completely enclose the free standing structure to a downward position where the left and right tarp expose the free standing structure. This device also includes a moving mechanism for moving the plurality of support members from the downward position to the upward position.

7 Claims, 3 Drawing Sheets

FIRE RESISTANT HOUSE COVER

BACKGROUND OF THE INVENTION

1. Field of the Invention

The present invention relates generally to a fire isolation device for free standing structures. More particularly, the present invention relates to a fire resistant house cover.

2. Description of the Prior Art

Every year free standing structures are either destroyed or endangered by out of control forest fires. These forest fires burn out of control usually because they are just too large for fire fighting personnel to contain. Out of control forest fires can easily destroy any free standing fire prone structure in their path. Therefore, there is a need for a fire protection device that can isolate free standing fire prone structures such as single family homes from out of control forest fires.

Numerous innovations for fire isolation devices have been provided in the prior art that are described as follows. Even though these innovations may be suitable for the specific individual purposes to which they address, they differ from the present invention as hereinafter contrasted.

U.S. Pat. No. 3,828,856 to Wallis discloses a fire blanket pack consisting of a fire resistant blanket inside a closed container. This patent differs from the present invention because it does not disclose any mechanism employing fire resistant materials for isolating free standing structures.

U.S. Pat. No. 5,051,290 to Stober et al. discloses a fire barrier blanket for isolating a fire within a spliced portion of an electrical cable or conduit. This patent differs from the present invention because it does not disclose any mechanism employing fire resistant materials for isolating free standing structures from external fires.

U.S. Pat. No. 5,091,243 to Tolbert et at. discloses a fire resistant fabric suitable for use as a flame barrier. This patent differs from the present invention because it does not disclose any mechanism employing fire resistant materials for isolating free standing structures.

U.S. Pat. No. 5,188,186 to Nash discloses a fire resistant barrier for isolating a fire within a confined area such as a mine shaft. This patent differs from the present invention because it does not disclose any mechanism employing fire resistant materials for isolating free standing structures from external fires.

Numerous innovations for fire isolation devices have been provided in the prior art that are adapted to be used. Even though these innovations may be suitable for the specific individual purposes to which they address, they would not be suitable for the purposes of the present invention as heretofore described.

SUMMARY OF THE INVENTION

In accordance with the present invention, a fire resistant house cover includes a fire resistant tarp, a support structure and a moving mechanism. The fire resistant tarp is of a dimension to fully enclose a free standing house. The support structure supports the fire resistant tarp when the tarp is in an upward position enclosing the free standing house and collapses when the tarp is in a downward position exposing the free standing house. The moving mechanism is capable of moving the tarp and support structure from the downward position to the upward position.

Broadly considered, the invention comprises a fire resistant cover that can be moved into a position to completely isolate a free standing structure from an external fire. This fire resistant cover can be readily moved into position by a user from either a local or remote site. The fire resistant cover may be manufactured in standard sizes that can be readily customized to fit varying size structures. When installed, this invention can prevent damage to a free standing structure and its contents from an external fire.

Accordingly, it is an object of the present invention to provide a device employing fire resistant materials for isolating free standing structures from external fire sources.

More particularly, it is an object of the present invention to provide a fire resistant house cover for isolating homes from uncontrolled forest fires.

In keeping with these objectives, and with others which will become apparent hereinafter, one feature of the present invention resides, briefly stated, in that the fire resistant house cover can completely enclose a free standing home with fire resistant material.

When the fire resistant house cover is designed in accordance with the present invention, it will provide reasonable protection for free standing homes from out of control forest fires.

In accordance with another feature of the present invention, the fire resistant house cover can be activated by a local manual switch, a local heat sensing switch, remote radio transmitter, telephone or tied into a fire alarm.

Another feature of the present invention is that it is capable of moving to its upward position completely enclosing the home in a period of thirty minutes or less.

Yet another feature of the present invention is that it comes in standard sizes that can be easily customized to fit a variety of different size homes.

Still another feature of the present invention is that it has a continuous encasement around the perimeter of the house for storing the fire resistant tarp and the support structure when the fire resistant house cover is in its downward position, thereby preserving the aesthetic appearance of the house and protecting the fire resistant tarp and the support structure from environmental conditions.

Yet still another feature of the present invention is that the fire resistant tarp is fabricated from synthetic fire resistant material such as NOMEX (TM).

Still yet another feature of the present invention is that the support structure is fabricated from fire resistant materials such as metal, metal alloys, fiberglass, graphite or carbon reinforced composites.

Another feature of the present invention is that the moving mechanism consists of winches, cables and cable guides.

Another feature of the present invention is that clips attach the moving mechanism cables to the sides of the house to prevent injury and give an overall aesthetic appearance.

An object of the present invention is to provide protection to free standing homes from uncontrolled external fires.

A further object of the present invention is to reduce the risk of or minimize the damage to homes and its contents from uncontrolled forest fires, thereby reducing fire insurance premiums.

A further object of the present invention is to provide the fire resistant house cover at a relatively low cost.

The novel features which are considered characteristic for the invention are set forth in the appended claims. The invention itself, however, both as to its construction and its method of operation, together with additional objects and advantages thereof, will be best understood from the following description of the specific embodiments when read and understood in connection with the accompanying drawing(s).

BRIEF LIST OF REFERENCE NUMERALS UTILIZED IN THE DRAWING

10—fire resistant house cover 10

12—ground surface 12

14—house 14

16—storage encasement 16

18—storage encasement cover 18

19—storage encasement anchor ring 19

20A—left tarp 20A

20B—right tarp 20B

21—tarp anchor cord 21

22A—left front tarp cable 22A

22B—right front tarp cable 22B

22C—left rear tarp cable 22C

22D—right rear tarp cable 22D

24—tarp cable guide 24

26A—front winch 26A

26B—rear winch 26B

28—front pivotal anchor 28

30A—left front support member 30A

30B—right front support member 30B

32—pivoting hinge 32

34—tarp cable clip 34

BRIEF DESCRIPTION OF THE PREFERRED EMBODIMENT

DETAILED DESCRIPTION OF THE PREFERRED EMBODIMENT

Figure 1:
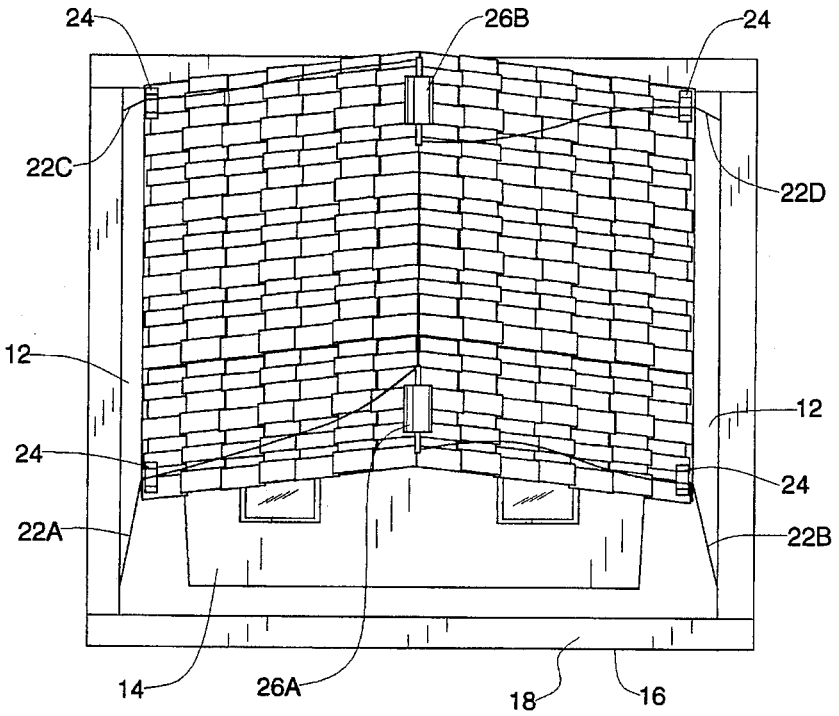
FIG. 1 is a top perspective view of the preferred embodiment of the fire resistant house cover having the left tarp and right tarp in the downward position exposing the house.

FIG. 1 is a top perspective view of the preferred embodiment of the fire resistant house cover 10 having the left tarp (not shown) and right tarp (not shown) in the downward position exposing the house 14 exhibiting the following features: ground surface 12; house 14; storage encasement 16; storage encasement cover 18; left front tarp cable 22A; right front tarp cable 22B; left rear tarp cable 22C; right rear tarp cable 22D; tarp cable guide 24; front winch 26A; and rear winch 26B.

The storage encasement 16 is a continuous trench in the ground surface 12 around the perimeter of the house 14. The storage encasement preferably should be lined with a rigid noncorrosive material such as a plastic or plastic composite. The storage encasement 16 contains the left tarp (not shown), right tarp (not shown), left front support member (not shown) and right front support member (not shown) when they are in the downward position. Keeping the left tarp (not shown), right tarp (not shown), left front support member (not shown) and right front support member (not shown) in the storage encasement 16 helps preserve the aesthetic appearance of the house 14 and also shields these parts from environmental conditions. Located on the top of the storage encasement 16 is the storage encasement cover 18, which is pivotally mounted to the inner surface of the storage encasement 16. The storage encasement cover 18 is a safety feature that prevents anyone from inadvertently tripping over or falling into the storage encasement 16, thereby injuring themselves.

The lower portions of the left front tarp cable 22A, right front tarp cable 22B, left rear tarp cable 22C and right rear tarp cable 22D extend into the storage encasement 16 as shown. These cables inside the storage encasement 16 are attached to the left tarp (not shown) and right tarp (not shown) respectively. The left front tarp cable 22A, right front tarp cable 22B, left rear tarp cable 22C and right rear tarp cable 22D provide part of the means to pull the left tarp (not shown) and right tarp (not shown) into the upward position enclosing the house 14.

Located at each of the four comers on the roof of the house 14 is a tarp cable guide 24. The tarp cable guide 24 guides each of the tarp cables. The top ends of both the left front tarp cable 22A and the right front tarp cable 22B are attached to the front winch 26A. Similarly, the top ends of both the left rear tarp cable 22C and the right rear tarp cable 22D are attached to the rear winch 26B. The front winch 26A and the rear winch 26B are mounted on the front and rear portions of the roof of the house 14 respectively. The front winch 26A and the rear winch 26B provides the mechanical force to pull the left tarp (not shown) and right tarp (not shown) into the upward position.

During operation the front winch 26A and the rear winch 26B must be activated in order to move the left tarp (not shown) and right tarp (not shown) into the upward position. The activation means can be by a local manual switch, local heat sensing switch, remote radio transmitter, telephone or tied into a fire alarm.

Figure 2:
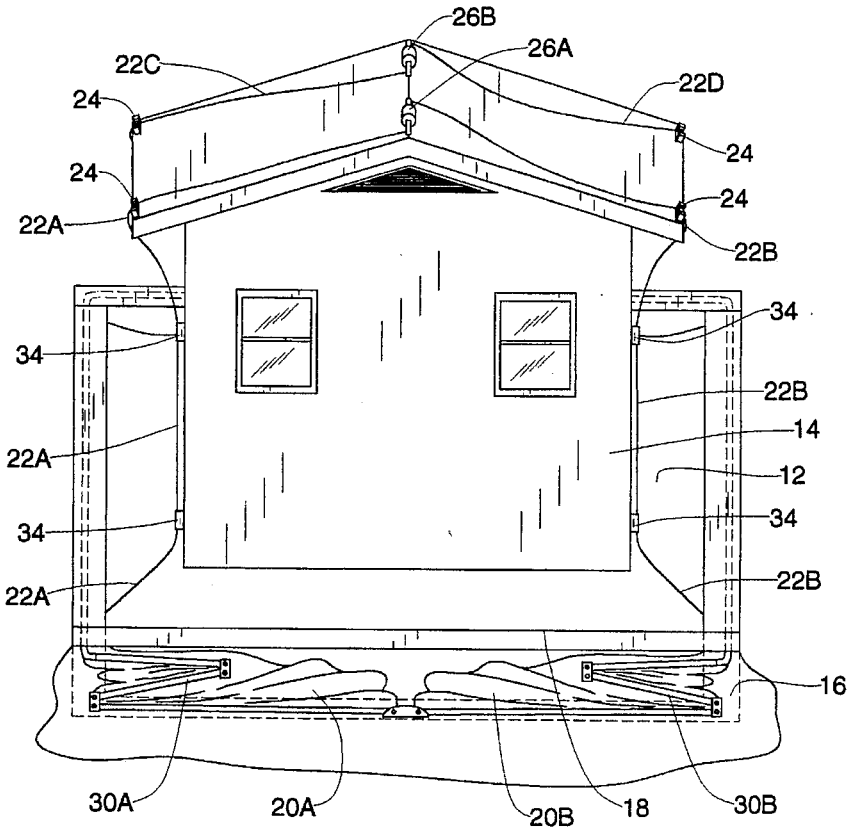
FIG. 2 is a front perspective view of the preferred embodiment of the fire resistant house cover having the left tarp and right tarp in the downward position exposing the house.

FIG. 2 is a top perspective view of the preferred embodiment of the fire resistant house cover 10 having the left tarp 20A and right tarp 20B in the downward position exposing the house 14 exhibiting the following features: ground surface 12; house 14; storage encasement 16; storage encasement cover 18; left tarp 20A; right tarp 20B; left front tarp cable 22A; right front tarp cable 22B; left rear tarp cable 22C; right rear tarp cable 22D; tarp cable guides 24; front winch 26A; rear winch 26B; tarp cable clips 34; left front support member 30A; and right front support member 30B.

Two tarp cable clips 34 are shown located on the front—bottom portion of both the left and right wall of the house 14. There are also two more tarp cable clips 34 (not shown) on the rear—bottom portion of both the left and right wall of the house 14. When the left tarp 30A and right tarp 30B is in the downward position, the left front tarp cable 22A, right front tarp cable 22B, left rear tarp cable 22C and right rear tarp cable 22D snap into the adjacent tarp cable clip 34, thereby holding the four tarp cables flush to the walls of the house 14 as shown. This serves as a safety feature preventing a person from walking into or tripping over one of the tarp cables, thereby injuring themselves.

The left tarp 20A, right tarp 20B left front support member 30A and right front support member 30B are contained within the storage encasement 16 when they are in the downward position.

Figure 3:
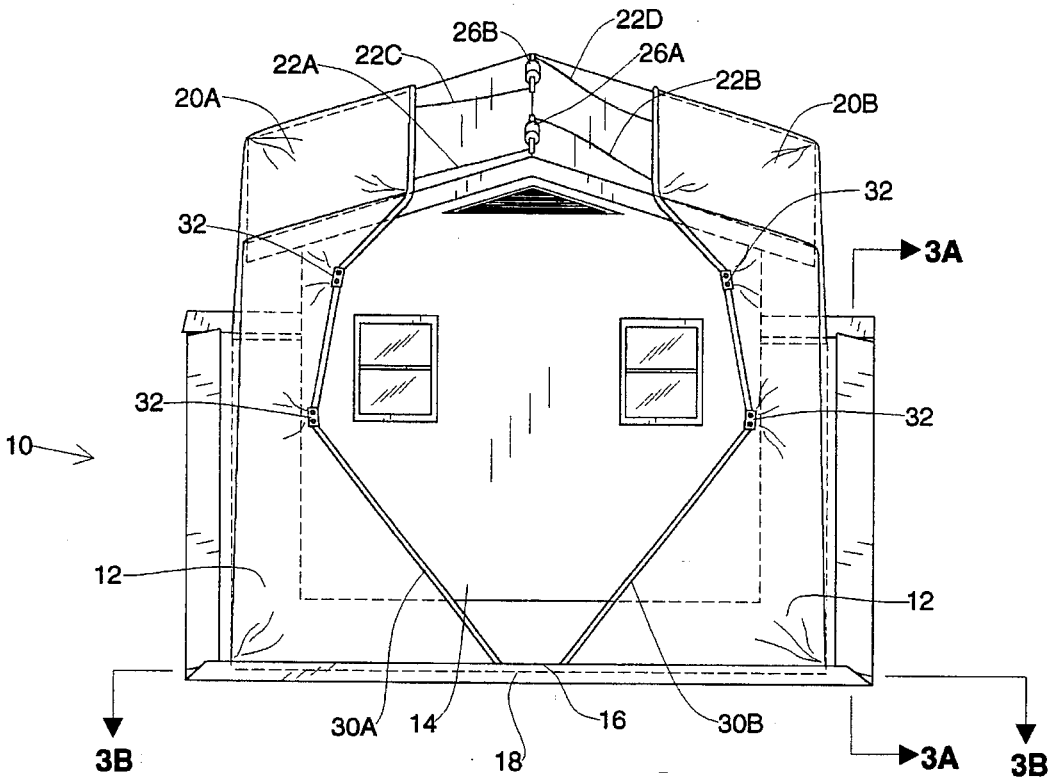
FIG. 3 is a front perspective view of the preferred embodiment of the fire resistant house cover having the left tarp and right tarp in the halfway between the upward and downward position partially enclosing the house.

FIG. 3 is a front perspective view of the preferred embodiment of the fire resistant house cover 10 having the left tarp 20A and right tarp 20B halfway between the upward and downward position partially enclosing the house 14 exhibiting the following features: fire resistant house cover 10; ground surface 12; house 14; storage encasement 16; storage encasement cover 18; left tarp 20A; right tarp 20B; left front tarp cable 22A; right front tarp cable 22B; left rear tarp cable 22C; right rear tarp cable 22D; front winch 26A; rear winch 26B; left front support member 30A; right front support member 30B; and pivoting hinges 32.

Figure 3A:
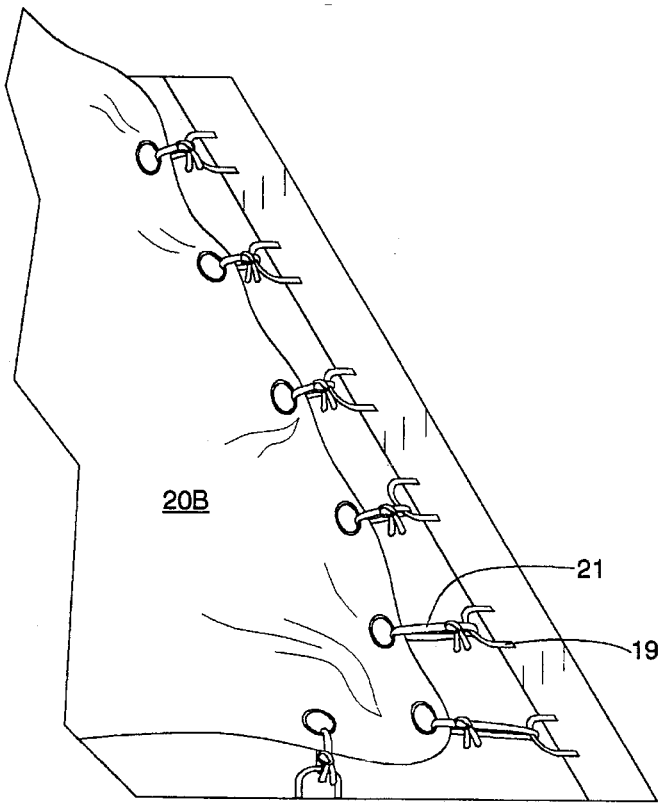
FIG. 3A is a cross sectional view of the storage encasement along the 3A axis of FIG. 3 showing the right tarp anchored within the storage encasement.

The left tarp 20A and right tarp 20B are shown being drawn up the walls of the house 14. Both the left tarp 20A and right tarp 20B have a front surface, top surface and back surface (not shown), and must be fabricated from a fire resistant material such as carbon-graphite, asbestos, metal, metal alloys, ceramic or plastic composites. The left tarp 20A and right tarp 20B must be of a dimension to completely enclose the house when they are in the upward position. The entire bottom edge of both the left tarp 20A and right tarp 20B are anchored within the storage encasement 16. This is accomplished by tarp anchor cords 21 attached to the lower edges of the left tarp 20A and right tarp 20B that are tied to anchor rings 19 located on the outer wall of the storage encasement 16. An example of a tarp anchor cord 21 and anchor ring 19 is shown in FIG. 3A. The tarp anchor cord 21 and anchor ring 19 pairs prevent the bottom portions of the left tarp 20A and right tarp 20B from being pulled upward, thereby exposing the bottom portion of the house 14. The edges of the top surfaces of both the left tarp 20A and right tarp 20B are each attached to their respective tarp cables 22A, 22B, 22C, 22D which allows the winches to pull the left tarp 20A and right tarp 20B into the upward position.

The left front support member 30A, right front support member 30B, left rear support member (not shown) and right rear support member (not shown) make up the support structure that rigidly supports both the left tarp 20A and right tarp 20B in the upward position. These support members should be fabricated from fire resistant materials such as, fiberglass, graphite or carbide reinforced composites.

The left front support member 30A and the right front support member 30B each consists of a lower portion, middle portion and an upper portion that are attached by two pivoting hinge 32. By the bottom pivoting hinge 32 pivoting inward and the top pivoting hinge 32 pivoting outward the pivoting hinges 32 allow the left front support member 30A and the right front support member 30B to fold in half from an extended position allowing them to fit into the storage encasement 16 when the left harp 20A and right harp 20B are in the downward position. The length of the bottom portions of left front support member 30A and the right front support member 30B cannot be longer than what can fit in the storage encasement 16. The middle and upper portion lengths are determined by the height of the house 14, but can be no longer than the bottom portions length. Also, the middle and upper portion lengths must be equal to ensure that the top end of the support members are adjacent to the top surfaces of the left tarp 20A and right harp 20B when in the storage encasement 16.

Figure 3B:
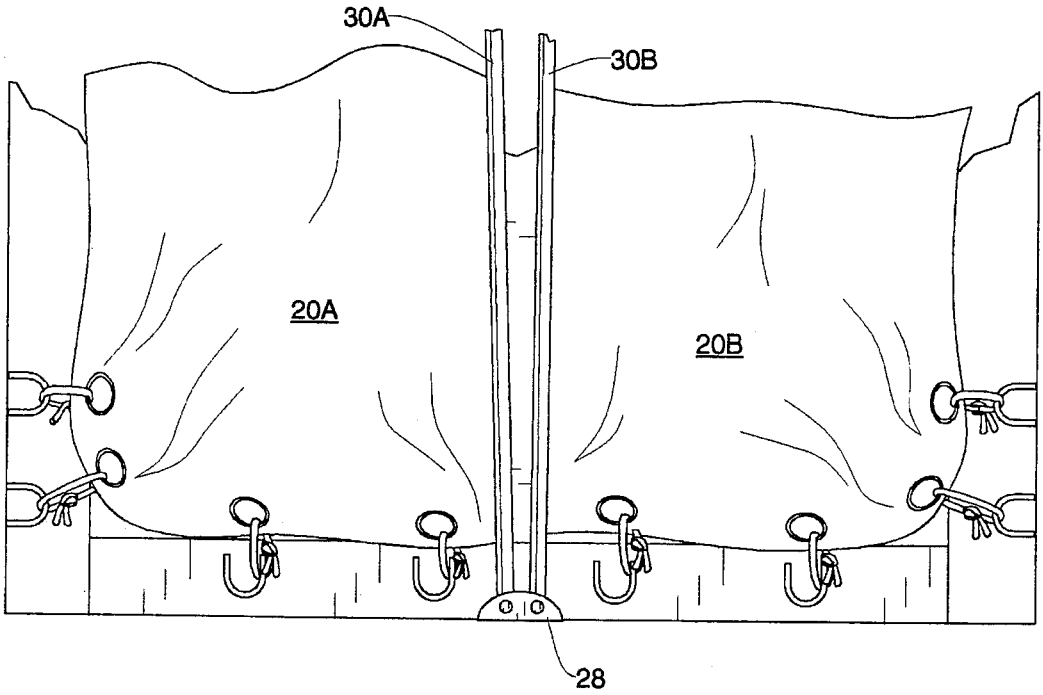
FIG. 3B is a cross sectional view of the storage encasement along the 3B axis of FIG. 3 showing the left front support member and the right front support member pivotally anchored within the storage encasement.

The top end of the left front support member 30A is attached to the front edge of the top surface of the left harp 20A and is contained within the front surface of the left tarp 20A. Similarly, the top end of the right front support member 30B is attached to the front edge of the top surface of the right tarp 20B and is contained within the front surface of the right harp 20B. Both bottom ends of the left front support member 30A and the right front support member 30B are attached to the front pivotal anchor 28 as shown in FIG. 3B. The front pivotal anchor 28 allows the left front support member 30A and the right front support member 30B to be rotated from a horizontal position when inside the storage encasement 16 to a vertical position when fully extended. The front pivotal anchor 28 is rigidly attached to the bottom surface of the storage encasement 16.

The left rear support member (not shown), right rear support member (not shown) and rear pivotal anchor (not shown) are assembled similarly and serve the same function as the previously described left front support member 30A and right front support member 30B.

Figure 4:
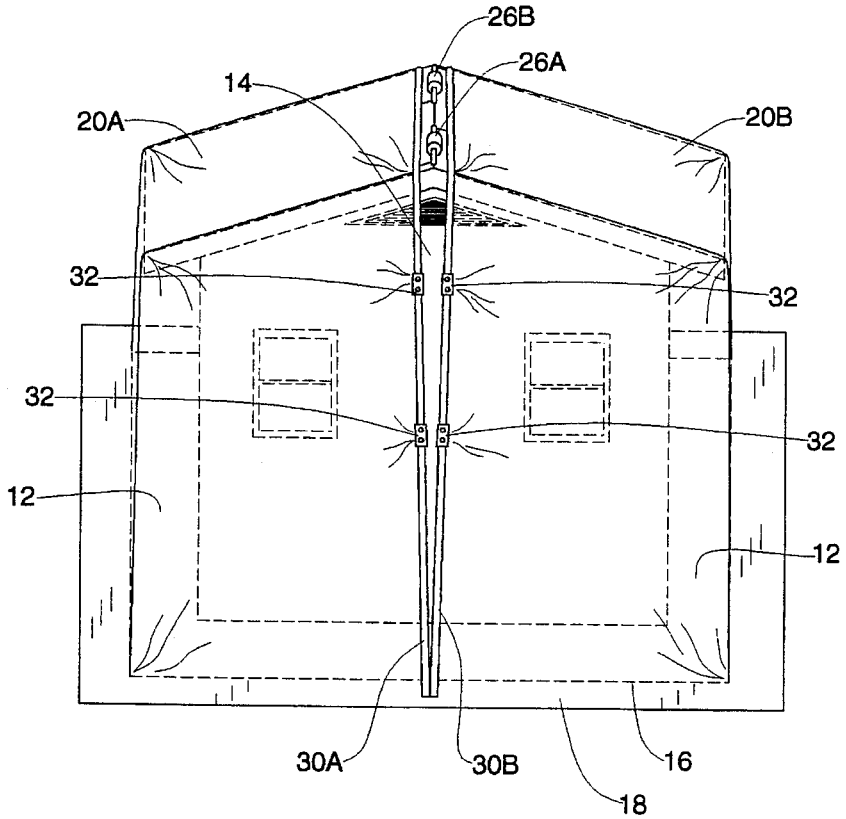
FIG. 4 is a front perspective view of the preferred embodiment of the fire resistant house cover having the left tarp and right tarp in the upward position enclosing the house.

FIG. 4 is a front perspective view of the preferred embodiment of the fire resistant house cover 10 having the left tarp 20A and right tarp 20B in the upward position enclosing the house 14 exhibiting the following features: ground surface 12; house 14; storage encasement 16; storage encasement cover 18; left tarp 20A; right tarp 20B; front winch 26A; rear winch 26B; left front support member 30A; right front support member 30B; and pivoting hinges 32.

The fire resistant house cover 10 is shown in the upward position completely enclosing the house. The left front support member 30A and the right front support member 30B are fully extended giving rigid support to the left tarp 20A and right tarp 20B. Due to the fire resistant nature of the left tarp 20A and right tarp 20B, the house can be isolated protecting it from fire damage.

During operation, the fire resistant house cover 10 starts in the downward position with the left tarp 20A, right tarp 20B, left front support member 30A and right front support member 30B contained in the storage encasement 16 as shown in FIG. 1. Also, in the downward position the tarp cables are snapped into their respective tarp cable clip 34 as shown in FIG. 2. The front winch 26A and rear winch 26B are then activated applying a force to the left front tarp cable 22A, right front tarp cable 22B, left rear tarp cable 22C and right rear tarp cable 22D. This force causes the tarp cables to snap out of their respective tarp cable clip 34 and be drawn toward the front winch 26A and rear winch 26B. This in turn causes the bottom ends of the tarp cables to exert a force on the top edges of the left tarp 20A and right tarp 20B. The top edges of the left tarp 20A and right tarp 20B will then simultaneously be drawn out of the storage encasement 16 and exert an upward force on the encasement storage cover 18 rotating it up and inward.

The left tarp 20A and right tarp 20B will further be drawn upward along the four sides of the house 14 from the storage encasement 16 and simultaneously the left front support member 30A, right front support member 30B, left rear support member (not shown) and right rear support member (not shown) will begin to unfold extending upward. Then the top pivoting hinge 32 pivots outward straightening the middle portion and the upper portion of the support members. Then the support members will rotate inwardly around their respective pivotal anchor causing the top surfaces of the left tarp 20A and right tarp 20B to be drawn over the roof of the house 14 as shown in FIG. 3. The left front support member 30A, right front support member 30B, left rear support member (not shown) and right rear support member (not shown) will continue to rotate inward and extend further upward. The further upward extension is caused by the four top pivotal hinges 32 pivoting outward. This continues drawing the three surfaces of both the left tarp 20A and right tarp 20B into their upward position completely enclosing the house 14 as shown in FIG. 4, thereby isolating the house 14 from a fire source.

When the fire resistant house cover 10 moves from the upward to the downward position the above sequence will be repeated in reverse. The front winch 26A and rear winch 26B will lower the left tarp 20A and right tarp 20 downward. Simultaneously the support members will rotate outward over the roof of the house 14 and then fold downward with the left tarp 20A and right tarp 20B into the storage encasement 16. The storage encasement cover 18 will then have to be manually rotated over the storage encasement. Also, the left front tarp cable 22A, right front tarp cable 22B, left rear tarp cable 22C and right rear tarp cable 22D will have to be manually placed into their respective tarp cable clip 34.

It will be understood that each of the elements described above, or two or more together, may also fund a useful application in other types of constructions differing from the type described above.

While the invention has been illustrated and described as embodied in a fire resistant house cover, it is not intended to be limited to the details shown, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A fire isolation device for protection of a fire prone free standing structure comprising:

a. a left tarp and a right tarp fabricated from a fire resistant material;

b. a plurality of support members connected to the left tarp and to the right tarp and being capable of moving to an upward position where the left tarp and the right tarp completely enclose the free standing structure from a downward position where the left tarp, the right tarp and the support members expose the free standing structure;

c. a means for moving the plurality of support members connected to the left tarp and the right tarp from the downward position to the upward position enclosing the free standing structure therein; and d. a storage encasement disposed around the perimeter of the free standing structure and containing the left tarp, the right tarp and the plurality of support members when the support members are in the downward position.

2. The fire isolation device of claim 1, wherein the storage encasement is disposed below ground level in a trough.

3. The fire isolation device of claim 1, wherein the plurality of support members is a front left support member, a front right support member, a rear left support member and a rear right support member, each support member made up of at least three portions, the portions of each support member interconnected by at least two hinges, the hinges allow each support member to move from an upward position where each support member is fully extended to a downward position where each support is folded down into the storage encasement.

4. The fire isolation device of claim 3, wherein:

a. the left tarp and the right tarp each have a lower edge, a front top edge and a rear top edge, the lower edge of both the left tarp and the right tarp is anchored within the storage encasement; and b. the front left support member, the front right support member, the rear left support member and the rear right support member each have a top end and a bottom end, the top end of the front left support member is attached to the front top edge of the left tarp, the top end of the front right support member is attached to the front top edge of the right tarp, the top end of the rear left support member is attached to the rear top edge of the left tarp, the top end of the rear right support member is attached to the rear top edge of the right tarp, the bottom end of both the front left support member and the front right support member is pivotally anchored within the storage encasement, the bottom end of both the rear left support member and the rear right support member is pivotally anchored within the storage encasement.

5. The fire isolation device of claim 4, wherein the storage encasement has a pivotally attached cover.

6. The fire isolation device of claim 5, wherein the fire resistant material of which the right tarp and the left tarp is fabricated is selected from the group consisting of carbon-graphite, asbestos, metal, metal alloys, ceramic, and plastic composites.

7. The fire isolation device of claim 6, wherein the front left support member, the front right support member, the rear left support member and the rear right support member is fabricated from a fire resistant material selected from the group consisting of carbon-graphite, asbestos, metal, metal alloys, ceramic, and plastic composites.

* * * * *